United States Patent [19]

Kittler

[11] 4,189,990

[45] Feb. 26, 1980

[54] FALSE CEILING

[75] Inventor: Helmut Kittler, Freiburg, Fed. Rep. of Germany

[73] Assignee: GIF Gesellschaft für Ingenieurprojekte Freiburg mbH, Freiburg, Fed. Rep. of Germany

[21] Appl. No.: 898,491

[22] Filed: Apr. 20, 1978

[30] Foreign Application Priority Data

Apr. 27, 1977 [DE] Fed. Rep. of Germany ..... 2718611

[51] Int. Cl.[2] ..... F24F 13/08

[52] U.S. Cl. ..... 98/121 R; 52/473; 55/444

[58] Field of Search ..... 98/121 R; 52/473; 15/238; 55/444, 464; 126/299 D

[56] References Cited

U.S. PATENT DOCUMENTS

| | | | |
|---|---|---|---|
| 1,695,768 | 12/1928 | Kelly | 98/121 R |
| 2,353,472 | 11/1967 | Lee et al. | 98/40 D |
| 2,354,466 | 7/1944 | Levinsen | 98/121 R |
| 2,618,331 | 11/1952 | Hicks et al. | 98/121 R |
| 3,834,135 | 9/1974 | Jordan | 126/299 D |
| 3,910,782 | 10/1975 | Struble et al. | 126/299 D |

FOREIGN PATENT DOCUMENTS

| | | | |
|---|---|---|---|
| 551756 | 1/1958 | Canada | 98/121 R |
| 2826 | of 1908 | United Kingdom | 98/121 R |
| 112939 | 7/1919 | United Kingdom | 98/121 R |

*Primary Examiner*—Ronald C. Capossela
*Attorney, Agent, or Firm*—Peter K. Kontler

[57] ABSTRACT

A false ceiling wherein a frame supports a set of elongated parallel horizontal trough-shaped slats each of which resembles or constitutes a portion of a hollow cylinder. The slats have longitudinally extending openings flanked by elongated marginal portions. The opening of one of each pair of neighboring slats faces upwardly, and the opening of the other slat of such pair faces downwardly. One marginal portion of one slat of each pair of neighboring slats extends into the interior of the other slat of the same pair and vice versa, and such marginal portions are spaced apart from each other to define passages wherein air can flow from the upper side to the underside of the false ceiling or in the opposite direction. The slats whose openings face upwardly collect liquid and/or solid constituents of air which flows upwardly and impinges against the concave undersides of slats whose openings face downwardly.

32 Claims, 14 Drawing Figures

1a
2
3
4
5
6
7
22
22a
23
24
M
P1
P2

FALSE CEILING

BACKGROUND OF THE INVENTION

The present invention relates to air-permeable grates or the like in general, and more particularly to improvements in false ceilings which permit air to flow in directions into and/or from the area therebelow. Still more particularly, the invention relates to improvements in false ceilings, grates and analogous air-permeable barriers which can be utilized in areas wherein the air contains moisture and/or other ingredients, such as atomized particles of grease or oil, droplets of aerosols and the like.

Contaminated air presents serious problems in many institutions wherein the air invariably or often contains a high percentage of moisture (water), atomized particles of oil and the like. Typical examples of such institutions are indoor swimming pools, shower rooms, laundry rooms, tailoring and cleaning establishments wherein garments are treated with steam, kitchens (especially large kitchens in restaurants, schools, military establishments and the like) as well as certain areas of many manufacturing plants wherein clouds of oil particles or droplets of aerosols develop in the course of manufacturing or processing operations. The contents of air in such institutions are not only harmful to occupants but also tend to contaminate the ceiling and, when condensed, tend to drip to the floor and/or onto the equipment which is installed in the room. In fact, the material which condenses or otherwise deposits on the ceilings often tends to initiate reactions which lead to biologically active excesses. Therefore, the walls (especially the ceilings) of such rooms must be cleaned or restored at frequent intervals, not only to enhance their appearance but also to reduce the likelihood of injury or health hazard to occupants and/or damage to equipment. The provision of conventional false ceilings in such areas is to no avail because the ceilings must be dismantled at frequent intervals for the purpose of cleaning, painting and/or other restoring operations. This is a time-consuming procedure which normally interferes with the work of occupants, unless it is carried out after working hours with additional expenditures for overtime.

It is further necessary to remove aerosols and other complex molecules from air in some of the above-enumerated institutions, especially if the air which is being withdrawn therefrom is to be recirculated into the same area. Such segregation of oil and like substances is especially desirable if the matter to be separated is likely to affect the condition of equipment which is used for the circulation of air. In such instances, even partial segregation of ingredients which are likely to attack the air circulating equipment is of considerable help in prolonging the useful life of such equipment and in reducing the intervals of idleness.

OBJECTS AND SUMMARY OF THE INVENTION

An object of the invention is to provide novel and improved false ceilings, gratings or analogous air-permeable barriers for use in areas wherein the air contains substantial quantities of moisture, atomized particles of oil or grease and/or other contaminants.

Another object of the invention is to provide a false ceiling which requires less frequent cleaning than heretofore known structural and/or false ceilings which are installed in areas where the deposition of condensate or the like results in rapid contamination of walls.

A further object of the invention is to provide a false ceiling which allows for practically unobstructed but controllable circulation of air into and/or from the area below the ceiling.

An additional object of the invention is to provide a novel and improved prefabricated false ceiling which exhibits the above-enumerated features.

Still another object of the invention is to provide a false ceiling which either greatly reduces the likelihood of or prevents the condensate that deposits thereon from dripping onto the floor or onto the persons or equipment in the area therebelow.

A further object of the invention is to provide a false ceiling which, in addition to its numerous utilitarian features, is of eye-pleasing appearance and can be manufactured at a relatively low cost.

Another object of the invention is to provide a false ceiling which can be installed in many areas as a superior substitute for presently employed false ceilings or which can be attached, at a reasonable cost, to existing structural ceilings.

An additional object of the invention is to provide a false ceiling which not only collects but also conceals the contaminants which are removed from air that passes therethrough.

The invention is embodied in an air-permeable barrier, particularly in a false ceiling or grate for interception of solid and/or liquid constituents of ascending air. The barrier comprises a plurality of parallel, substantially horizontal and substantially trough-shaped neighboring slats each having a longitudinally extending opening flanked by two elongated marginal portions. The opening of one slat of each pair of neighboring slats faces substantially upwardly and the opening of the other slat of each pair of neighboring slats faces substantially downwardly. One marginal portion of one slat of each pair of neighboring slats extends with clearance into the interior of the other slat of the respective pair and vice versa so that such marginal portions define passages extending lengthwise of the slats and permitting air to flow between the upper side and the underside of the barrier.

The slats preferably constitute or resemble portions of hollow elongated cylinders and the angular distance between their marginal portions, as measured across the respective openings, is not more than 180 degrees, i.e., each slat preferably extends along an arc of at least (and preferably more than) 180 degrees (as measured circumferentially of the slat from the one to the other of its marginal portions).

The barrier further comprises sheet metal or plastic panels or other suitable means for adjustably supporting at least some of the slats; such slats are preferably adjustable with respect to the supporting means in directions to vary the effective cross-sectional areas of the passages. This can be achieved by turning the slats about longitudinal axes or by moving the slats up or down.

The novel features which are considered as characteristic of the invention are set forth in particular in the appended claims. The improved air-permeable barrier itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 11:
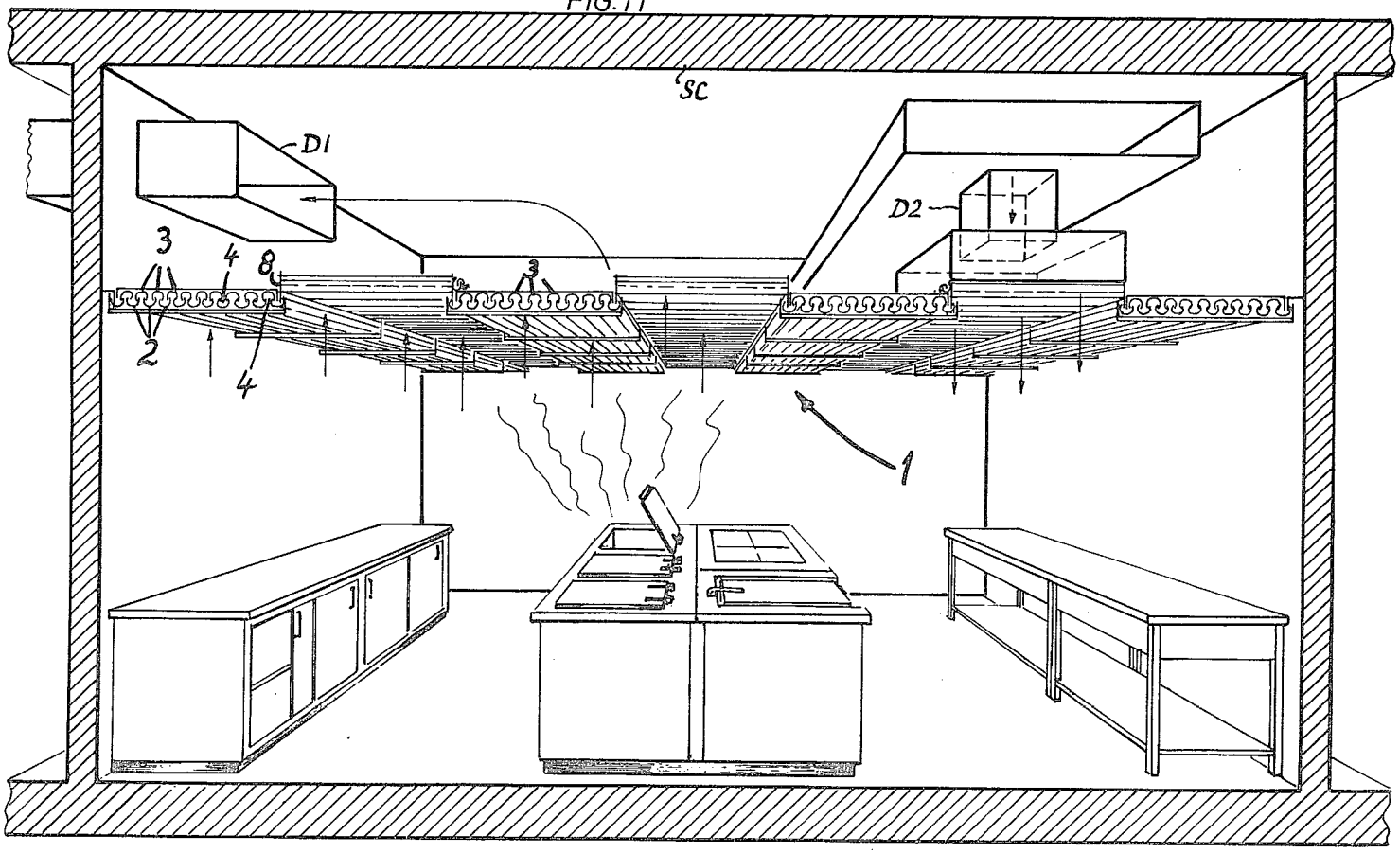
FIG. 11 is a perspective view of an establishment wherein the structural ceiling is fully concealed by a false ceiling of the type shown in FIG. 5.

Referring first to FIG. 11, there is shown a room which accommodates a substantial number of kitchen appliances and other equipment which can be found in the kitchen of a restaurant, hotel or an analogous institution. The false ceiling 1 is constructed and assembled in accordance with the invention and is installed below a structural ceiling SC. The space between the ceilings 1 and SC accommodates air circulating equipment including components (see the duct D2) which admit air into the area below the false ceiling as well as components (see the duct D1) which draw air from such area. In each instance, the air flows through certain units or modules of the false ceiling 1. The arrangement is such that air is drawn from the area below the false ceiling 1 in that (left-hand) part of the room which accommodates appliances likely or bound to generate vapors including water vapors or vapors containing oil, grease or the like. The right-hand part of the area below the false ceiling 1 is the working area and is located at a level below that module or those modules of the false ceiling 1 which admit fresh air or air that has been relieved, at least substantially, of moisture and/or other undesirable ingredients.

Figure 12:
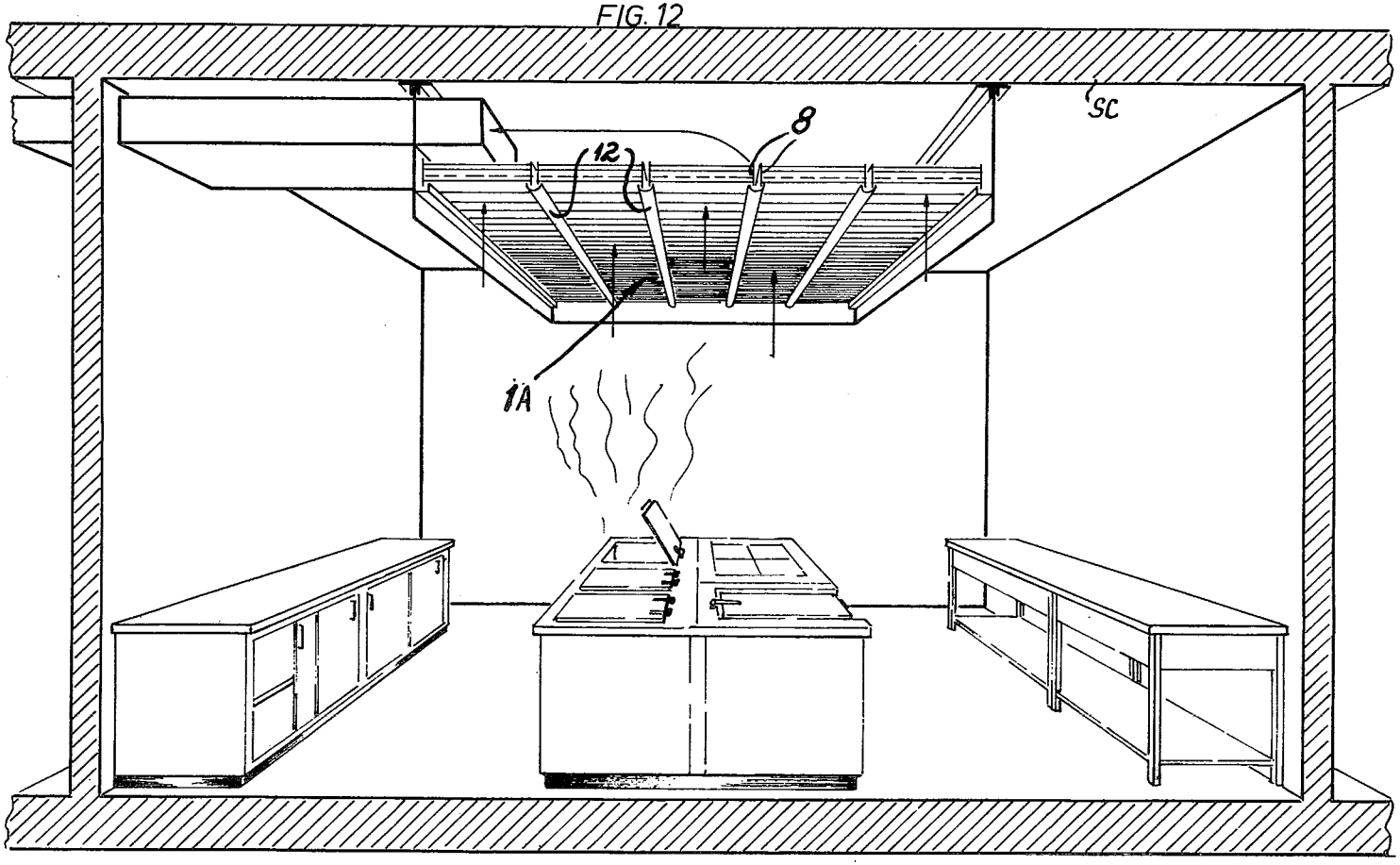
FIG. 12 is a similar perspective view but showing a modified false ceiling which overlies only a portion of the structural ceiling and is constructed in a manner as shown in FIGS. 4 and 9.

FIG. 12 shows a room wherein the equipment is similar to or identical with that in the room shown in FIG. 11. However, the false ceiling 1A covers only a certain portion of the structural ceiling SC, namely, the portion which is located above the appliances most likely to generate vapors containing moisture, particles of greasy substances and other contaminants which should be removed from air, especially if the same air is to be reintroduced into the area below the ceiling 1A.

Figure 1:
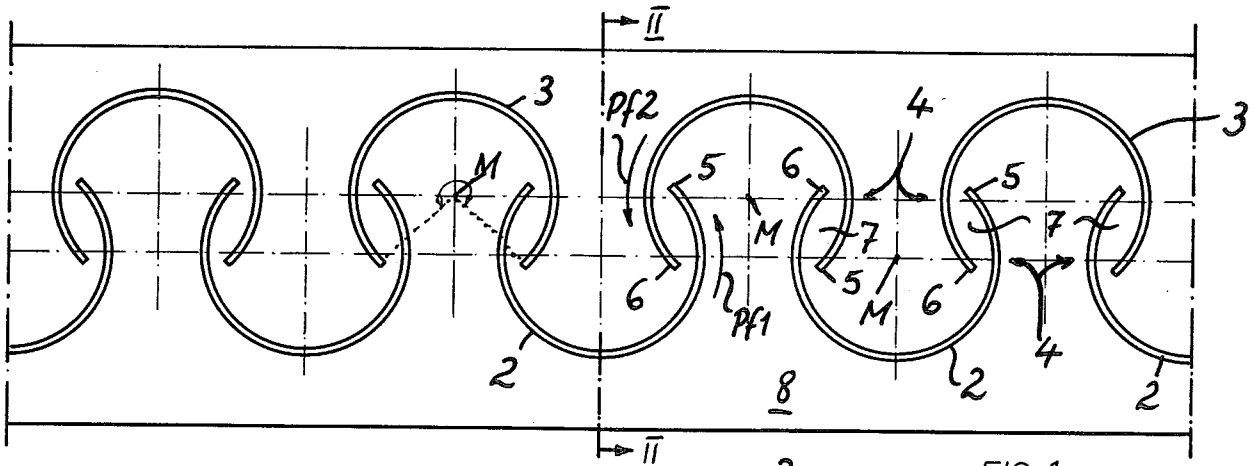
FIG. 1 is a fragmentary transverse sectional view of a unit or module forming part of a false ceiling which embodies the invention.
Figure 2:
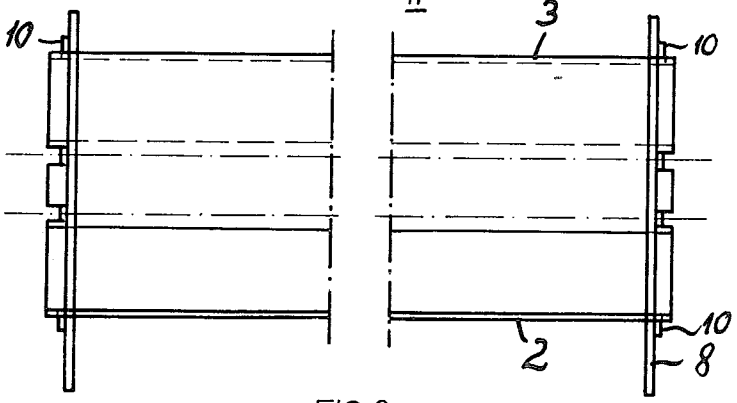
FIG. 2 is a fragmentary sectional view as seen in the direction of arrows from the line II—II of FIG. 1.

Referring now to FIGS. 1 and 2, there is shown a portion of the improved false ceiling, namely, a portion which constitutes a self-sustaining unit or module and can be assembled with one or more additional units to constitute therewith a composite false ceiling (1 or 1A) of the type shown in FIG. 11 or 12. The unit which is shown in FIGS. 1 and 2 comprises a plurality of elongated horizontal trough-shaped members 2 and 3 whose longitudinally extending openings 4 respectively face up and down. The marginal portions 5, 6 of the members 2 (hereinafter called slats for short) are out of contact with the marginal portions 5, 6 of the neighboring members of slats 3. These slats 2 and 3 form, in their entirety, an undulate body wherein the convex outer sides of the slats 2 and the concave inner sides of the slats 3 face downwardly.

Figure 8:
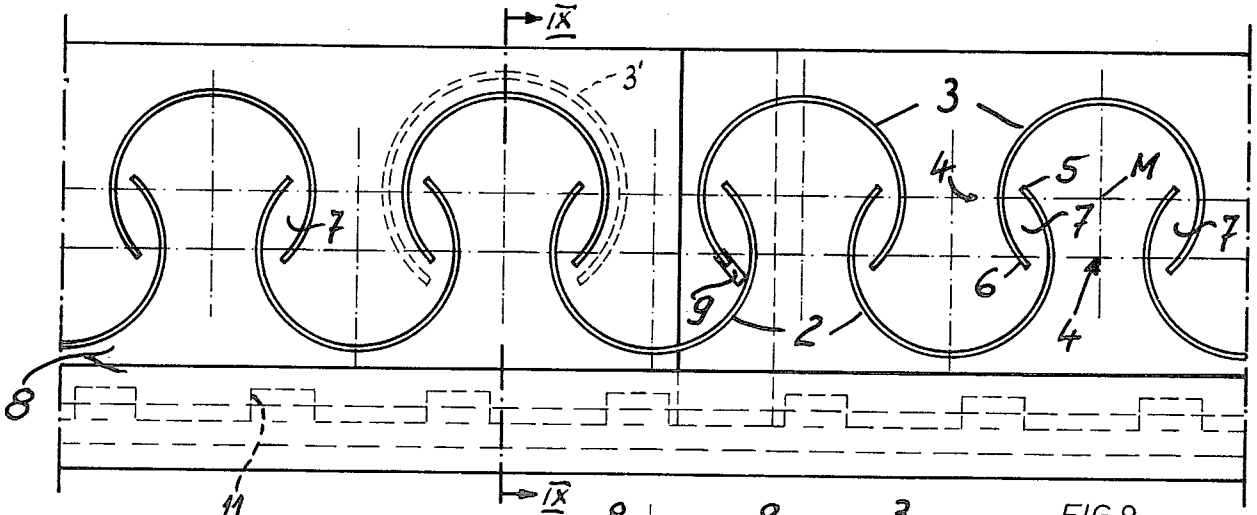
FIG. 8 is an enlarged vertical sectional view as seen in the direction of arrows from the line VIII—VIII of FIG. 4.

The end portions of the slats 2 and 3 extend through complementary arcuate slots of two spaced-apart vertical supporting panels 8 which are directly or indirectly supported by the structural ceiling and/or by a side wall of the room in which the false ceiling is installed. The reference characters 7 denote passages for air which are provided between the marginal portions 5, 6 of the slats 2 and the adjacent marginal portions 6, 5 of the slats 3. The width of each passage 7 increases gradually toward its center and thereupon decreases, as considered in the direction of air flow therethrough. Each slat 2 or 3 extends along an arc of approximately 270 degrees, as considered in the circumferential direction from its marginal portion 5 to its marginal portion 6 or vice versa. The imaginary central longitudinal axes of the slats 2 and 3 are shown at M. The configuration of slots in the supporting panels 8 is preferably such that each slat 2 and/or each slat 3 can be moved angularly about its axis M. Thus, each slat 2 can turn in and opposite to the direction indicated by the arrow Pf1, and each slat 3 can turn in and opposite to the direction indicated by the arrow $Pf_2$. This changes the effective cross-sectional areas of passages 7 between the marginal portions of neighboring slats 2 and 3. FIG. 8 shows one of the arcuate slots 9 in the supporting panels 8; this slot allows the respective slat 3 to turn counterclockwise beyond the illustrated position in which its marginal portions 5, 6 are located at the same level. It is clear that such slot can also extend beyond the other marginal portion 5 of the respective slat 3. The slots 9 are sufficiently long to allow neighboring slats 2 and 3 to assume extreme positions in which their marginal portions 5 and 6 abut each other.

In many instances, it suffices to construct the panels 8 in such a way that they allow for angular adjustments of some or all of the slats 2 or for angular adjustment of some or all of the slats 3. Such adjustments will be carried out when one wishes to change the extent of purification of air or to change the rate of air flow through the module or unit which includes the structure of FIGS. 1 and 2. The same result can be achieved by mounting the slats 2 in such a way that they can be raised or lowered with respect to the slats 3 and/or vice versa. This feature is not specifically shown because, even though obviously feasible, it is perhaps somewhat more complex than the feature including mounting the slats 2 and/or 3 for angular movement about the respective axes M. Moreover, a unit with turnable slats occupies less room than a unit wherein the slats 2 and/or 3 are movable up and down.

Adjustments of the slats 2 and/or 3 for the purpose of changing the effective cross-sectional areas of the passages 7 might be desirable when the difference between the temperature in the area below the false ceiling and the temperature of inflowing fresh air is very pronounced. It has been found that, by appropriate adjustment of the cross-sectional areas of the passages 7, one can avoid draft in the region below the ceiling even if the temperature of inflowing air is much lower than the temperature in the room.

FIG. 11 shows that several units or modules of the type shown in FIGS. 1 and 2 can be assembled into a composite false ceiling 1 and that the orientation of all slats 2 and 3 need not be the same, i.e., the slats 2 and 3 in one unit may extend at right angles to the slats 2 and 3 in the neighboring unit or units. Furthermore, it is not necessary to install all units at the same level. A staggered installation might be desirable for several reasons, e.g., to facilitate the suspension of units on the structural ceiling SC, to facilitate attachment of neighboring units to each other, and/or to enhance the appearance of the false ceiling. However, the primary and most advantageous purpose of the improved units is to intercept and gather solid impurities, aerosols and simple or complex molecules (water vapors, vaporized oil and the like) in such a manner that at least the major percentage of intercepted ingredients is not visible from below because condensate and other separated contaminants accumulate in the interior of the lower slats 2. As already mentioned in connection with FIG. 11, the units permit inflow of fresh or cleaned air as well as the outflow of air which carries vapors, aerosol particles or the like.

Another important advantage of the improved false ceiling is that it allows for inexpensive recovery or reutilization of heat which would be lost if hot air that rises toward and passes through the false ceiling were permitted to escape into the atmosphere. As shown in FIG. 11, the left-hand duct D1 draws hot air from the region above the ranges or ovens. Such air is relieved of moisture, other vapors, dust and/or other undesirable contaminants during its passage through the units. Therefore, the duct D1 can readily admit such air into one or more heat exchangers for recovery of heat energy before the air is discharged into the atmosphere. Preliminary cleaning of extracted air during passage through the ceiling 1 insures that the heat exchanger or heat exchangers are not contaminated, or that their contamination to an extent which warrants cleaning takes up much more time than in the absence of the improved false ceiling. Furthermore, and since the rate of air flow through each unit or through certain groups of units can be regulated independently of the other unit or units, the outflow of hot air above the ranges or ovens and above any other appliances which are the cause of emission of moist or otherwise contaminated air can be adjusted independently of the rate of inflow of fresh air to other parts of the area below the false ceiling. If desired, air which is withdrawn via duct D1 can be readmitted via duct D2.

The slats 2 and 3 preferably constitute portions of hollow cylinders, i.e., their radii of curvature are preferably constant. This simplifies the manufacture and, furthermore, when such slats are assembled in a manner as shown in FIG. 1 (wherein each slat extends along an arc of approximately 270 degrees, as considered in the circumferential direction from the marginal portion 5 toward the marginal portion 6), the neighboring marginal portions 5, 6 of the slats 2, 3 necessarily define oval or substantially oval passage 7 of optimum shape, i.e., each passage has a narrow inlet, it thereupon expands, and its width then decreases in the direction of air flow. Such configuration of the passages 7, which is a necessary adjunct of the design of the slats 2 and 3, insures that the speed of air which flows therethrough changes to thus promote condensation of vapors on the surfaces bounding the passage 7 as well as the deposition of a high percentage of droplets or solid contaminants. It has been found that the degree of purification of air which flows through the improved false ceiling is surprisingly high. Purified air can be readily reintroduced into the space below the false ceiling, i.e., it is not necessary (at least in most instances) to convey the air through a filter prior to release into the surrounding atmosphere or back into the room from which the air was withdrawn. Satisfactory purification is attributed, at least to some extent, to the fact that the passages 7 are bounded by relatively large (concave) surfaces, i.e., there is ample room for deposition of condensate or the like on the surfaces bounding the passage before the respective air streams rise toward the centers of concave sides of the slats 3.

As also shown in FIG. 1, the distance between the marginal portions 5 and 6 of a slat 2 or 3 (as measured along an arc spanning the respective opening 4 and having its radius of curvature on the axis M) is less than 180 degrees (as mentioned above, the slats extend along arcs of approximately 270 degrees; therefore, the aforementioned arcs extend along 90 degrees). The length of such arcs should not exceed 180 degrees.

It goes without saying that the slats 2 and 3 may have a polygonal or oval cross-sectional outline. It is also possible to manufacture the slats in such a way that their marginal portions form parts of cylinders but that their intermediate portions have an oval or polygonal cross-sectional outline.

Figure 3:
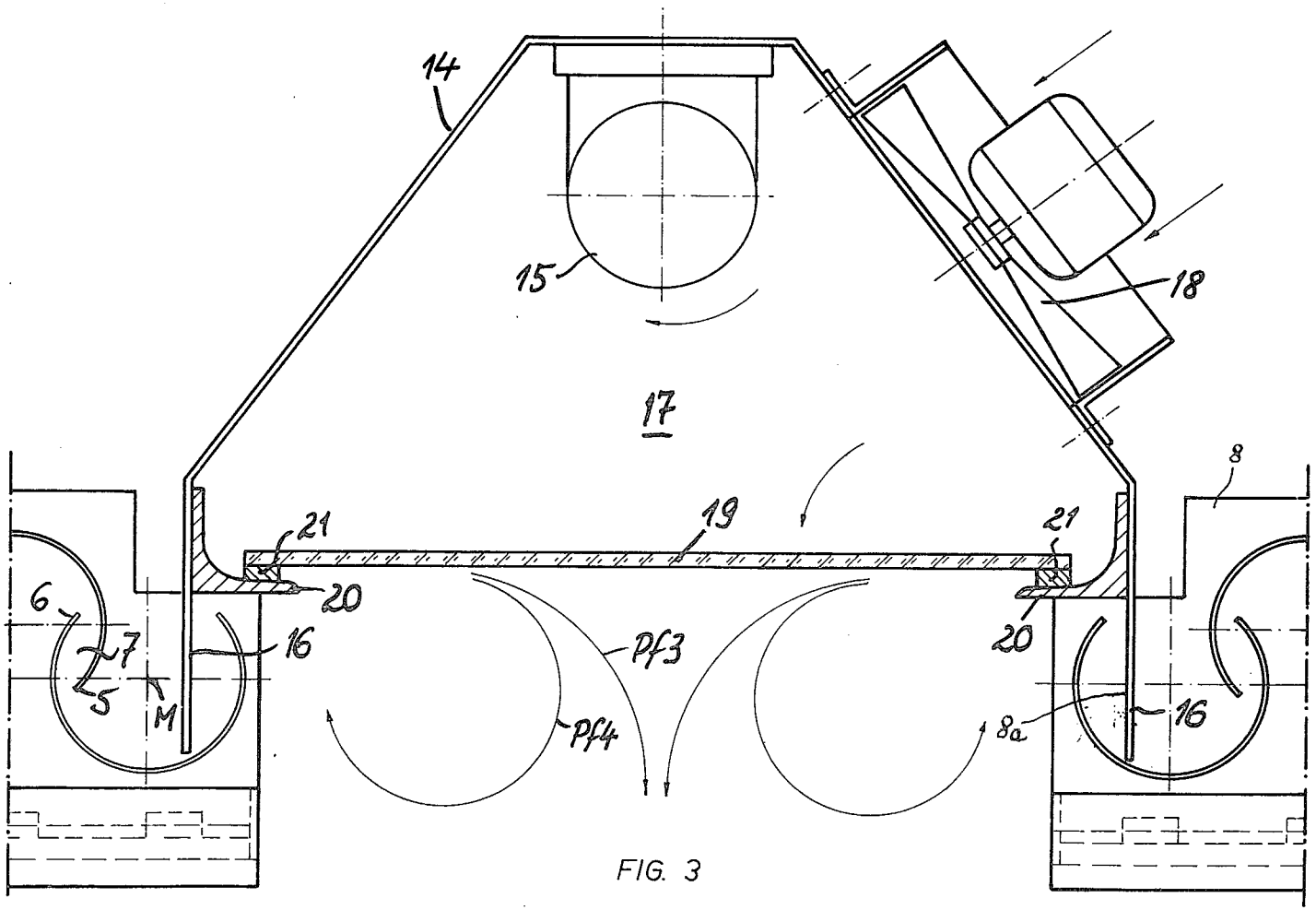
FIG. 3 is a fragmentary vertical sectional view of a portion of a modified false ceiling which embodies the invention, the section being taken in the direction of arrows as seen from the line III—III of FIG. 6.
Figure 6:
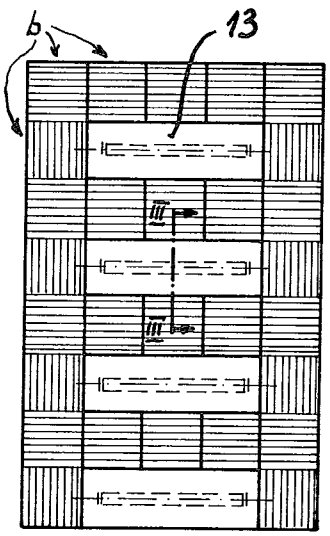
FIG. 6 is a bottom plan view of another assembly of modules which resembles the assembly of FIG. 5 and further includes several illuminating inserts.

FIG. 3 shows the details of one of the four illuminating arrangements or inserts of FIG. 6. The reference character 14 denotes a housing or casing which supports an elongated tubular light source 15 (e.g., a fluorescent lamp) and a light-transmitting pane 19 below the lamp. The casing 14 has downwardly extending flanges 16 which extend into the outermost slats 2 of the neighboring modules or units. The flanges 16 are received in slits 8*a* of the adjacent supporting panels 8. These flanges carry brackets 20 for distancing elements 21 which are disposed between the horizontal ledges of the brackets 20 and the underside of the light-transmitting pane 19 to provide a number of paths for the flow of air from the internal space 17 of the casing 14 into the space below the pane or vice versa. A blower 18 which is mounted in the casing 14 forces air to flow into the space 17 and to penetrate into the region below the pane 19. The arrows Pf3 and Pf4 indicate the directions in which the air flows into and circulates in the region below the pane 19. An advantage of the blower 18 is that it reduces the likelihood of accumulation of contaminants at the underside of the pane 19. Thus, streams of air which flow along the paths between the distancing elements 21 insure that vapors, droplets of aerosol or the like which rise toward the false ceiling are directed away from the pane 19 and rise toward the adjacent units to pass between the slats 2, 3 and to be intercepted by slats 3 and directed into the slats 2. Air which is admitted from the internal space 17 of the casing 14 into the space below the pane 19 is admixed to air which rises toward and passes through the adjacent units. It is not necessary that the blower 18 draw clean atmospheric air, i.e., contamination of the underside of the pane 19 is prevented (or at least delayed) if the intake of the blower 18 draws air from the space above the adjacent units because such air is purified during passage between the slats 2 and 3.

Figure 4:
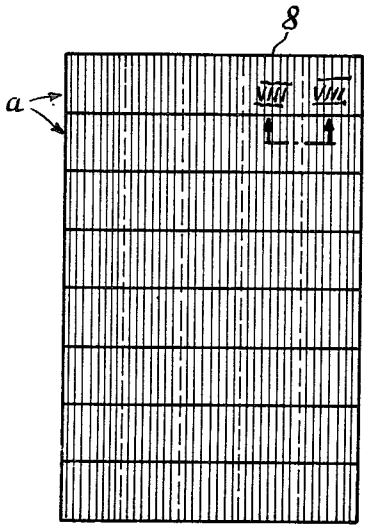
FIG. 4 is a schematic bottom plan view of an assembly of modules which are constructed in a manner as shown in FIGS. 1 and 2 and are mounted at the same level.

FIGS. 4 to 7 show different arrays of units or modules which are constructed in accordance with the invention. In FIG. 4, several units a are mounted in parallel, i.e., the slats 2, 3 of each unit are parallel to each other and each slat 2 or 3 of any one unit is in exact register with a slat 2 or 3 of the adjacent unit. All of the supporting panels 8 are parallel to each other and extend at right angles to the axes of the slats 2 and 3.

Figure 5:
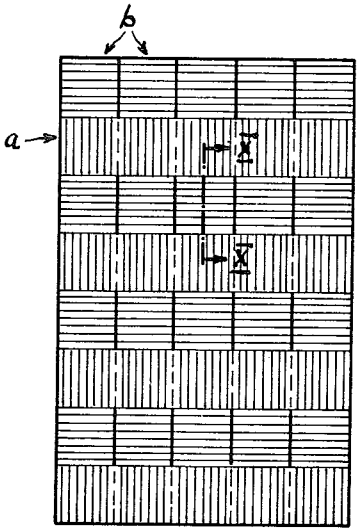
FIG. 5 is a schematic bottom plan view of an assembly of modules including modules of the type shown in FIGS. 1-2 and 4 as well as modified modules, the modules being disposed in different planes.

In FIG. 5, units a of the type shown in FIG. 4 alternate with rows of shorter modules or units b whose slats 2, 3 extend at right angles to the slats 2, 3 of the units a.

In FIG. 6, units b are arrayed in the form of a framework for several illuminating inserts 13 of the type shown in FIG. 3.

Figure 7:
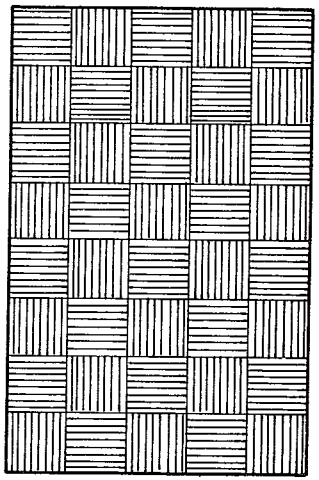
FIG. 7 is a bottom plan view of still another assembly.

In FIG. 7, the units b form a checkerboard pattern, i.e., the slats 2, 3 in each pair of neighboring units b forming part of a row or column are disposed at right angles to each other.

The structures which are shown in FIGS. 4 to 7 may form self-supporting assemblies, i.e, several units can be combined into larger groups or assemblies which are self-supporting to facilitate installation or removal, for example, for the purpose of cleaning. The slats 2 and/or 3 of each unit a or b can be adjusted independently of the slats 2 and/or 3 in neighboring units, or all slats 2 and/or 3 in the units which form a larger unit or assembly can be adjusted at the same time. The false ceiling 1 of FIG. 1 is similar to the assembly which is shown in FIG. 5.

The supporting panels 8 preferably consist of sheet metal. As mentioned above, the length of slots 9 (FIG. 8) in the panels 8 preferably exceeds the circumferential length of the slats 2 and 3 to an extent which is necessary to allow for maximum adjustment of the neighboring slats 2 and 3 with respect to each other. Thus, by turning the second slat 3 from the right (FIG. 8) in a counterclockwise direction, the marginal portion 6 of this slat 2 comes into direct contact with the marginal portion 5 of the adjacent slat 2, i.e., the effective cross-sectional area of the corresponding passage 7 is reduced to zero. The slots 9 can be formed in the panels 8 during severing of such panels from larger blanks, i.e., the cost of making the slots is minimal. The manufacturing cost of the improved false ceiling can be reduced still further by employing slats 2 whose dimensions are identical with those of the slats 3. However, it is clear that the slats 2 need not be identical with the slats 3; for example, the radii of curvature of the slats 3 (i.e., of those slats whose concave sides face downwardly) could be larger than the radii of curvature of the slats 2. This is indicated in FIG. 8 by broken lines, as at 3'. Such units are desirable in rooms wherein the ascending air contains a high percentage of vapors, droplets or the like.

Figure 9:
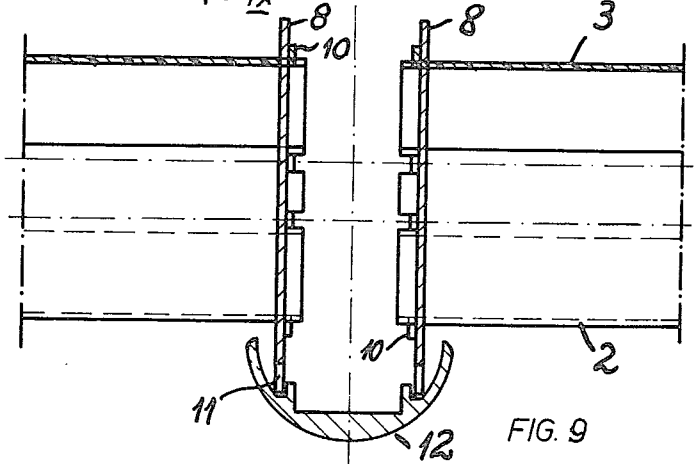
FIG. 9 is a sectional view as seen in the direction of arrows from the line IX—IX of FIG. 8.

The slats 2 and 3 can be held against axial movement relative to the corresponding supporting panels 8 in a number of different ways. For example, one could employ wedges which are inserted into openings provided in the end portions of the slats 2 and 3 at the outer sides of the respective panels 8. FIG. 9 shows that the end portions of the slats 2 and 3 have readily deformable projections or lugs 10 which can be bent out of the general planes of the respective end portions to overlie the outer sides of the corresponding panels 8 and to thus hold the slats 2 and 3 against axial movement. Such projections to not interfere with angular adjustment of the slats 2 and 3 about the axes M. Furthermore, the projections 10 (plus friction between the slats 2 and 3 and the panels 8) hold the slats 2 and 3 against movement out of the selected positions.

Figure 10:
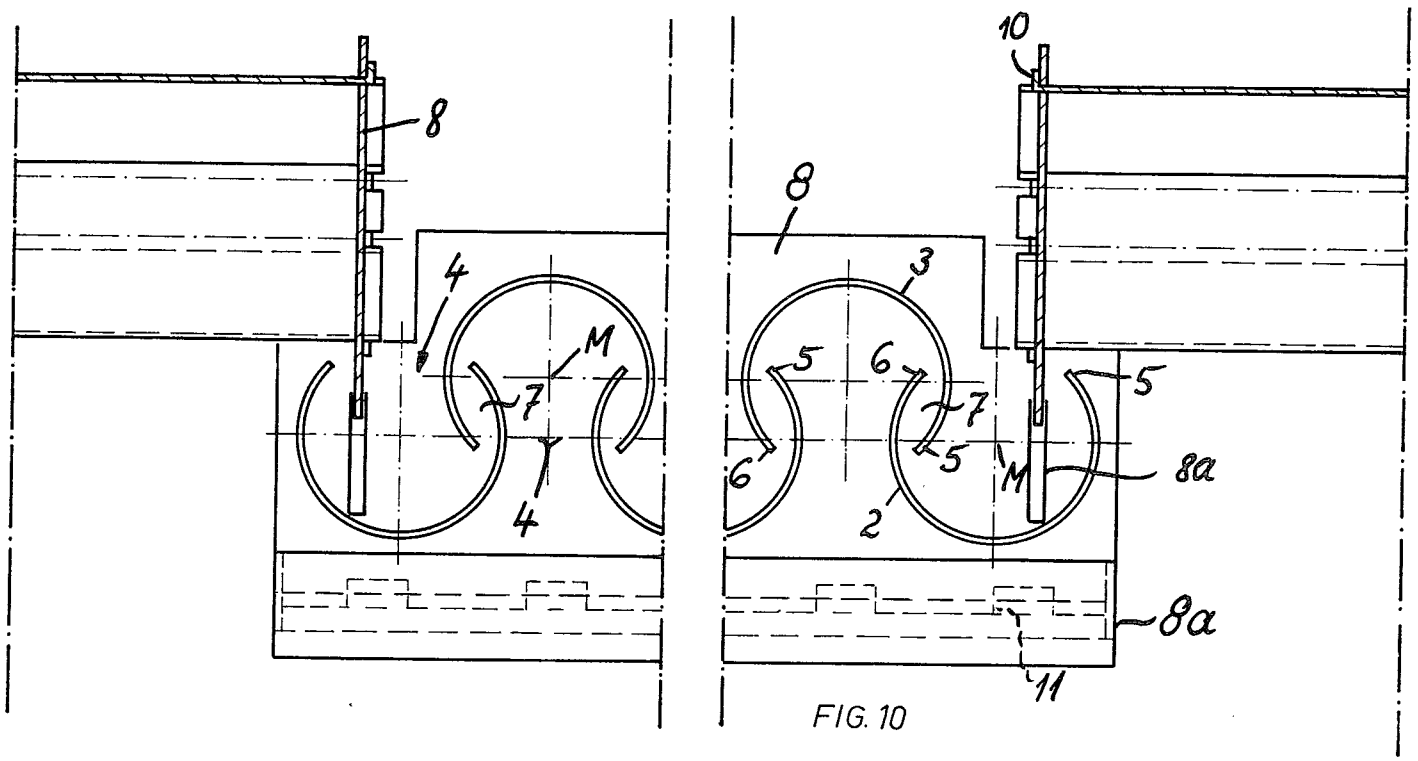
FIG. 10 is an enlarged sectional view as seen in the direction of arrows from the line X—X of FIG. 5.

The manner in which the panels 8 of neighboring units can be separably secured to each other is shown in FIGS. 9 and 10. The connections which are shown therein can be used to connect a section a of FIG. 5 with a neighboring section b or to secure a section b of FIG. 7 to a neighboring section b, i.e., to connect sections whose slats 2, 3 extend at right angles to each other. The neighboring units of FIG. 10 are disposed at different levels and the lower edge portions (or parts of such lower edge portions) of the panels 8 forming part of the upper unit extend downwardly into upwardly open slits **8*a* of the panels 8 forming part of the lower units. The slits 8*a* extend below the openings 4 of the outermost slats 2 of the lower units. Such mode of connecting results in some interlacing of the neighboring units and enhances the stability of the assembled false ceiling. The panels 8** which are connected to each other in the just described manner are disposed in vertical planes at right angles to each other.

The lower edge portions of the panels 8 are preferably serrated (as shown at 11) whereby the alternating teeth and tooth spaces provide additional channels or apertures for the flow of air from the space above the false ceiling to the space therebelow or vice versa. The serrations may be formed by removing parts of the respective lower edge portions or by bending spaced-apart parts of such lower edge portions from the general plane of the respective panel 8. The interlaced panels may but need not be fixedly connected to each other; for example, such fixed connections are unnecessary if each unit or module is suspended on the structural ceiling SC by resorting to commercially available hardware.

Units of the type shown in FIG. 4 (or the neighboring units of a row of units shown in FIG. 5) can be connected to each other in a manner as shown in FIG. 9. The panels 8 of neighboring units are spaced apart and are parallel to each other, and their lower edge portions extend into suitable sockets of a channel-shaped profiled coupling member 12 having a convex underside and overlying the gap between the neighboring panels 8. The serrated lower end portions 11 of the panels 8 permit air to flow from the gap between the neighboring panels into the space below the false ceiling or vice versa. The coupling members 12 can serve the additional purpose of intercepting and collecting condensate which might trickle through the slots 9 and into the gap between the panels 8 of FIG. 9.

It will be noted that the connection of FIG. 10 also insures that condensate or other flowable material which has penetrated through the slots 9 of the upper supporting panels 8 cannot drip from the false ceiling because the upper panels 8 are disposed between the marginal portions 5, 6 of the slats 2 therebelow, i.e., the slats 2 collect the liquid which happens to flow beyond the ends of slats 2 in the upper units.

The mounting of adjacent units in criss-cross fashion in a manner as shown in FIG. 10 exhibits another important advantage. For example, if the ceiling portion which is shown in FIG. 10 consists of prefabricated units a and b, and the dimensions of the false ceiling are such that the size of at least one unit (e.g., the lower unit of FIG. 10) must be reduced in order to cover the desired part of the structural ceiling, the width of the lower unit can be reduced accordingly by removing a certain number of slats 2, 3 and by reducing the length of the associated panels 8. It is preferred to remove at least two slats, namely, a slat 2 and a slat 3 so that the lower end portion of an upper panel 8 extends into the outermost slat 2 therebelow.

Figures 13, 14:
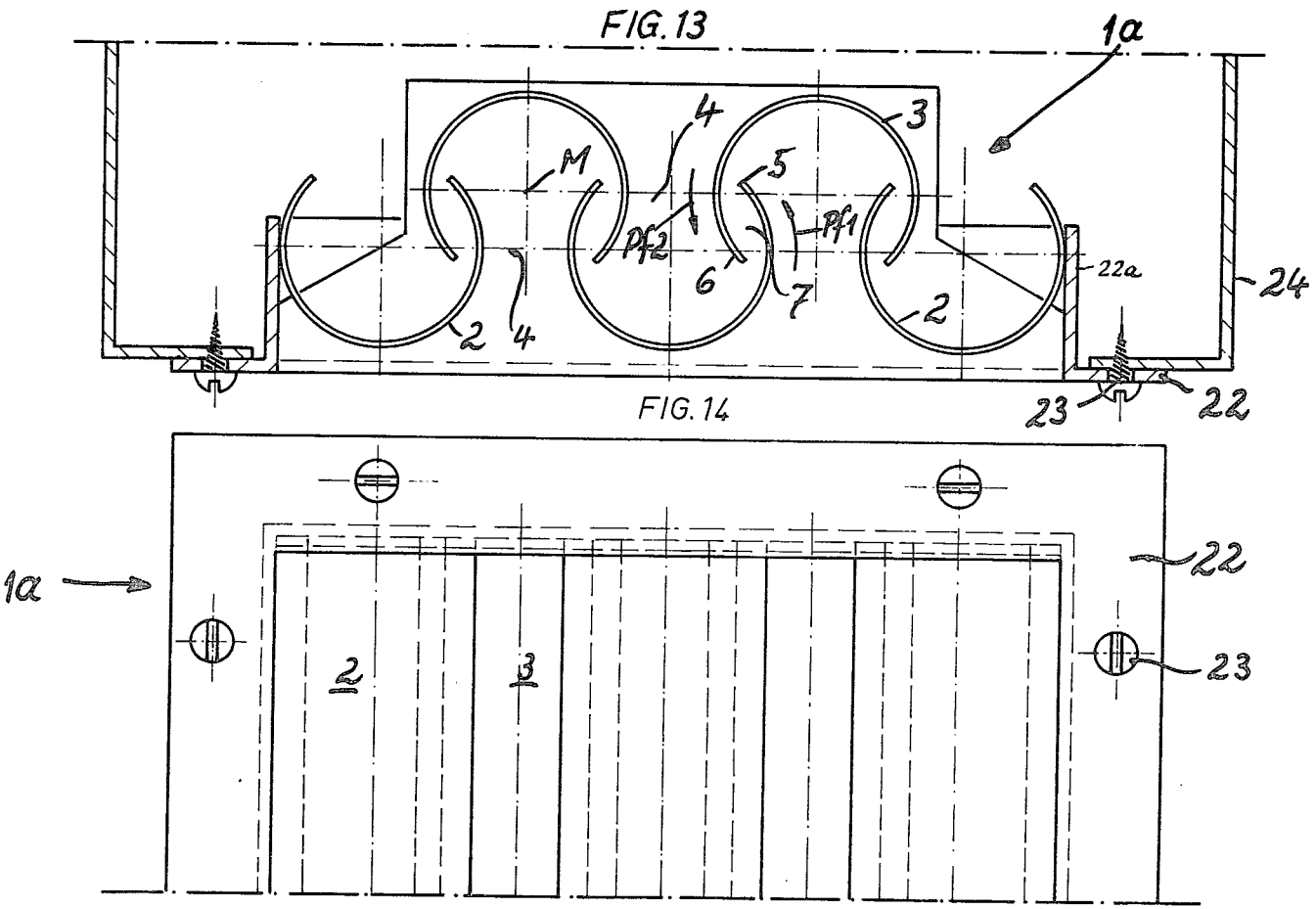
FIG. 13 is a fragmentary vertical sectional view of still another embodiment of the invention.
FIG. 14 is a bottom plan view of the structure which is shown in FIG. 13.

Referring finally to FIGS. 13 and 14, there is shown a square or rectangular support 24 which can carry one or more prefabricated units or groups of units in such a way that the unit or group of units is readily detachable, for example, in order to remove accumulations of intercepted contaminants from the lower slats 2. The unit 1*a* which is shown in FIGS. 13 and 14 has a frame including two panels 8 and side walls 22*a* with outwardly extending ledges 22 which overlie the underside of the lower portion of the support 24. The ledges 22 are separably secured to the support 24 by screws 23 or analogous fasteners. The support 24 may constitute a component (e.g., a duct) of an air conditioning or air circulating system. The slats 2 and 3 are preferably detachable from the frame of the unit 1*a* so as to allow for convenient cleaning in a commercial washing or rinsing plant.

The structure of FIGS. 13 and 14 can be used as a grate or the like in an air-evacuting opening of a ceiling, as a grate or the like in the inlet opening of an air withdrawing duct, or for analogous purposes. In other words, the improved air-permeable barrier can be used as a full-sized false ceiling, as a false ceiling which overlies a part of a structural ceiling, or as a relatively small grate which merely overlies a small or medium-sized opening to insure that its slats 2 and 3 effect a preliminary or complete cleaning of air that rises toward its underside and passes between its slats 2 and 3. In most instances, the improved barrier will be mounted in such a way that the slats 2 and 3 are horizontal and that the concave sides of alternate slats face downwardly. Thus, when the barrier which is shown in FIGS. 13 and 14 is installed in an opening to constitute a grate at the intake of a duct which draws air from a room, e.g., from a kitchen, it can constitute an effective means for intercepting grease, oil and similar evaporatable substances which are heated in the room and are drawn into the inlet by a fan or the like.

The slats 2, 3, the supporting panels 8, the frames and/or other parts of the improved barrier can be made of a variety of materials. For example, corrosion-resistant metals (such as stainless steel) will be used if the false ceiling is installed in a kitchen. If the false ceiling is used in rooms wherein the atmosphere is not likely or not expected to contain highly corrosive substances, e.g., when the air which flows between the slats 2 and 3 contains solid contaminants, the slats and/or other parts can be made of a suitable inexpensive synthetic plastic material. The same applies if the barrier merely serves to change the direction of air flow or to break up inflowing air into several discrete streams. It is desirable to select the material, or at least the material of the outermost layers, of the parts of the improved barrier in such a way that the parts can be readily cleaned, either upon separation from each other or as component parts of a fully assembled unit or group of coherent units. As mentioned above, the slats and/or other parts of the improved barrier are preferably designed (and their material selected) in such a way that they can be inserted into commercial washing machines.

Anodic or other suitable surface treatment of slats and/or other parts often suffices to insure long-lasting resistance to the action of corrosive impurities in the surrounding atmosphere. Aluminum is one of the presently preferred materials because of its low cost and low specific weight.

An important advantage of each embodiment of the improved barrier is that the likelihood of contamination of ceilings in kitchens, shower rooms and other establishments wherein the air contains large quantities of moisture, other vapors, aerosol droplets, or the like, is reduced, that the units of the barrier can be readily cleaned, that the barrier allows for adjustment of the rate of air flow therethrough, and that the barrier prevents intercepted liquids from contaminating the floor or equipment therebelow. Furthermore, the improved barrier is beneficial to the health of occupants of the space therebelow because it collects deleterious constituents of air and prevents such constituents from descending into the space where the occupants would be likely to be affected thereby. Finally, the barrier is of eye-pleasing appearance, its cost is reasonable, and it is sufficiently versatile to allow for its installation below large, small, square, rectangular or irregularly shaped structural ceilings.

Finally, it is also within the purview of the invention to make the slats 2 longer (as considered in their circumferential direction) than the slats 3, or vice versa. For example, the slats 2 or 3 may extend along arcs of approximately 270 degrees, and the slats 3 or 2 may extend along arcs of approximately 180 degrees.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. An air-permeable barrier, particularly a false ceiling or grate for interception of solid and/or liquid constituents of ascending air, comprising a plurality of parallel, substantially horizontal and substantially trough-shaped neighboring slats each bounding an internal space of a predetermined width and including two elongated marginal portions each having a marginal edge, said marginal edges flanking a substantially longitudinally extending opening and being spaced apart by less than said predetermined width as considered across said opening, the opening of one slat of each pair of neighboring slats facing substantially upwardly and the opening of the other slat of each pair of neighboring slats facing substantially downwardly, one marginal portion of one slat of each pair of neighboring slats extending with clearance through said opening and into said internal space of the other slat of the respective pair and vice versa, said marginal portions of each pair of neighboring slats cooperating with one another to define a respective passage through which air can flow between the upper side and the underside of the barrier said passages having flow-through cross-sectional areas which are narrower at, and wider at a distance from, the respective marginal edges of at least one of said cooperating marginal portions of the respective pair of neighboring slats.

2. A barrier as defined in claim 1, wherein said slats constitute or resemble portions of hollow cylinders and the angular distance between said marginal edges, as measured across the respective openings, is less than 180 degrees.

3. A barrier as defined in claim 2, wherein the cross sections of said slats extend along arcs greater than 180 degrees.

4. A barrier as defined in claim 1, further comprising means for adjustably supporting at least some of said slats, such slats being adjustable with respect to said supporting means in directions to vary the effective cross-sectional areas of said passages.

5. A barrier as defined in claim 4, wherein said adjustable slats are turnable in said supporting means about axes which are parallel to the marginal edges thereof.

6. A barrier as defined in claim 4, further comprising means for holding said adjustable slats in selected adjusted positions.

7. A barrier as defined in claim 1, wherein said slats constitute portions of hollow cylinders and at least one of each pair of neighboring slats extends along an arc of approximately 270 degrees, as considered in the circumferential direction thereof.

8. A barrier as defined in claim 1, further comprising supporting means for said slats, said supporting means and said slats together constituting a self-supporting module which can be suspended from the structural ceiling of a room or the like.

9. A barrier as defined in claim 8, wherein each of said slats comprises a first and a second end portion and said supporting means comprises first and second panels extending substantially transversely, and connected to the respective end portions, of said slats.

10. A barrier as defined in claim 9, wherein said panels have arcuate slots for the respective end portions of said slats.

11. A barrier as defined in claim 10, wherein at least some of said slots extend beyond the marginal edges of the respective slats so that the corresponding slats are angularly adjustable with respect to said panels.

12. A barrier as defined in claim 11, wherein the length of said slots is such that the corresponding slats are turnable to and from positions of abutment with neighboring slats.

13. A barrier as defined in claim 1, wherein all of said slats are of identical size and shape.

14. A barrier as defined in claim 1, wherein the radii of curvature of slats whose openings face upwardly exceed the radii of curvature of the other slats.

15. A barrier as defined in claim 1, wherein each of said slats has a first and a second end portion and further comprising first and second supporting panels extending transversely of said slats and having complementary slots for the respective end portions of said slats, and means for holding said slats against lengthwise movement with respect to said panels.

16. A barrier as defined in claim 15, wherein said holding means comprises deformable projections forming part of said end portions and overlying the outer sides of the respective panels.

17. A barrier as defined in claim 1, further comprising a frame for said slats.

18. A barrier as defined in claim 17, wherein said slats are separably secured to said frame.

19. A barrier as defined in claim 1, wherein said slats consist of corrosion-resistant material.

20. A barrier as defined in claim 19, wherein said material is a metal.

21. A barrier as defined in claim 1, wherein said slats consist of synthetic plastic material.

22. A barrier as defined in claim 1, wherein said slats have first and second end portions and further comprising first and second supporting panels extending transversely of said slats and having complementary slots for the respective end portions of said slats, said panels and said slats together constituting a first module and further comprising a second module adjacent to said first module.

23. A barrier as defined in claim 22, wherein said second module is disposed at a level below said first module and one panel of said first module has a downwardly extending edge portion, one panel of said second module having a slit into which said edge portion extends and the panels of said first module being disposed substantially at right angles to the panels of said second module.

24. A barrier as defined in claim 23, wherein said edge portion extends into the upwardly facing opening of one slat of said second module.

25. A barrier as defined in claim 23, wherein said edge portion has several apertures for the flow of air therethrough.

26. A barrier as defined in claim 22, wherein one panel of said first module is adjacent to but spaced from one panel of said second module, said adjacent panels having downwardly extending edge portions and further comprising coupling means disposed between said adjacent panels and having sockets for said edge portions.

27. A barrier as defined in claim 26, wherein said coupling means has a concave upper side intermediate said sockets.

28. A barrier as defined in claim 26, wherein said edge portions have apertures for the passage of air therethrough.

29. A barrier as defined in claim 22, wherein said modules are coplanar and one panel of one said modules is adjacent to but spaced from one panel of the other of said modules, and further comprising an illuminating insert disposed between said adjacent panels.

30. A barrier as defined in claim 29, wherein said insert comprises a casing having two downwardly extending flanges secured to said adjacent panels.

31. A barrier as defined in claim 30, wherein said casing has an internal space and further comprising means for drawing air upwardly from said internal space.

32. A barrier as defined in claim 31, wherein said insert further comprises a light source in said casing, a light-transmitting pane below said source, and distancing means interposed between said casing and said pane to define a plurality of paths for the flow of air from below said pane, along said paths and into said internal space.

* * * * *